United States Patent [19]

Phipps et al.

[11] Patent Number: 4,753,385

[45] Date of Patent: Jun. 28, 1988

[54] EXTENDABLE MAILBOX TRAYS

[75] Inventors: Colin S. Phipps; Joseph W. Arnett; William P. Thompson; Charles E. Benedict, all of Tallahassee, Fla.

[73] Assignee: Benedict Engineering Company, Inc., Tallahassee, Fla.

[21] Appl. No.: 829,899

[22] Filed: Feb. 18, 1986

[51] Int. Cl.[4] ..... B65P 91/00

[52] U.S. Cl. ..... 232/17; 211/132; 232/30

[58] Field of Search ..... 232/17, 1 A, 1 C, 1 D, 232/1 E, 30, 33, 45, 19; 229/101, 164, 165, 172, 174, 178; 206/557; 211/131, 132, 126; D32/53.1

[56] References Cited

U.S. PATENT DOCUMENTS

| | | | |
|---|---|---|---|
| 838,194 | 12/1906 | Larsh | 232/17 |
| 908,543 | 1/1909 | Brown | 232/17 |
| 1,050,252 | 1/1913 | Thorson | 232/33 |
| 2,781,964 | 2/1957 | Ledgerwood | 232/17 |
| 2,868,444 | 1/1959 | Whittier | 232/33 |
| 3,415,585 | 12/1968 | Morris | 211/126 |
| 4,160,520 | 7/1979 | Cluthé | 232/17 |
| 4,345,710 | 8/1982 | Gillespie et al. | 229/16 R |
| 4,362,267 | 12/1982 | Donaldson | 232/17 |
| 4,600,143 | 7/1986 | Harlow, Jr. et al. | 232/17 |

FOREIGN PATENT DOCUMENTS

| | | | |
|---|---|---|---|
| 1440764 | 6/1976 | United Kingdom | 229/172 |

OTHER PUBLICATIONS

Patent Office Disclosure Document 123687, 1/9/84, by Albert Lewis Harlow.

Supplemental Information Disclosure Statement, USA (Ser. No.: 702,060 filed 2/15/85) filed in PTO 4/19/85, 6 photos (public availability date unknown prior to 7/15/86).

*Primary Examiner*—John Weiss

*Attorney, Agent, or Firm*—Dowell & Dowell

[57] ABSTRACT

Extendable trays for use in conventional rural route mailboxes for facilitating the placement and removal of mail with respect thereto wherein the trays are constructed utilizing scored or integrally hinged sheet material which is selectively folded into a generally flat or planar configuration or package for shipping or distribution and which is assembled by a postal customer so as to be of a size and configuration to be cooperatively and slidingly received within a particular mailbox. In one form of the invention, the sheet material may be selectively folded into a number of sizes so that trays of varying dimensions may be formed from the same sheet of material.

15 Claims, 5 Drawing Sheets

Fig. 9
Fig. 6
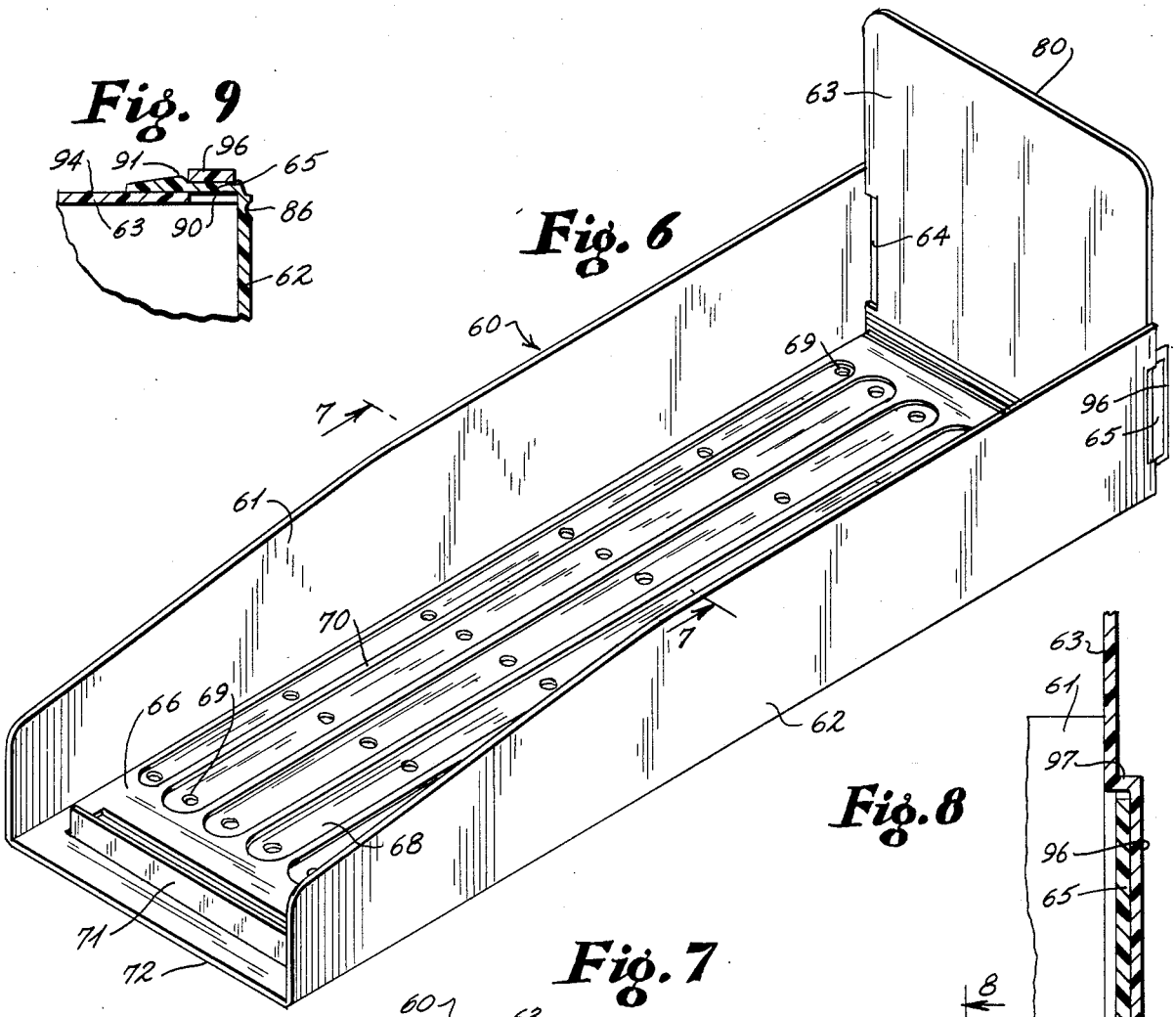
Fig. 8
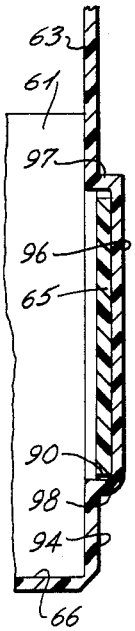
Fig. 7
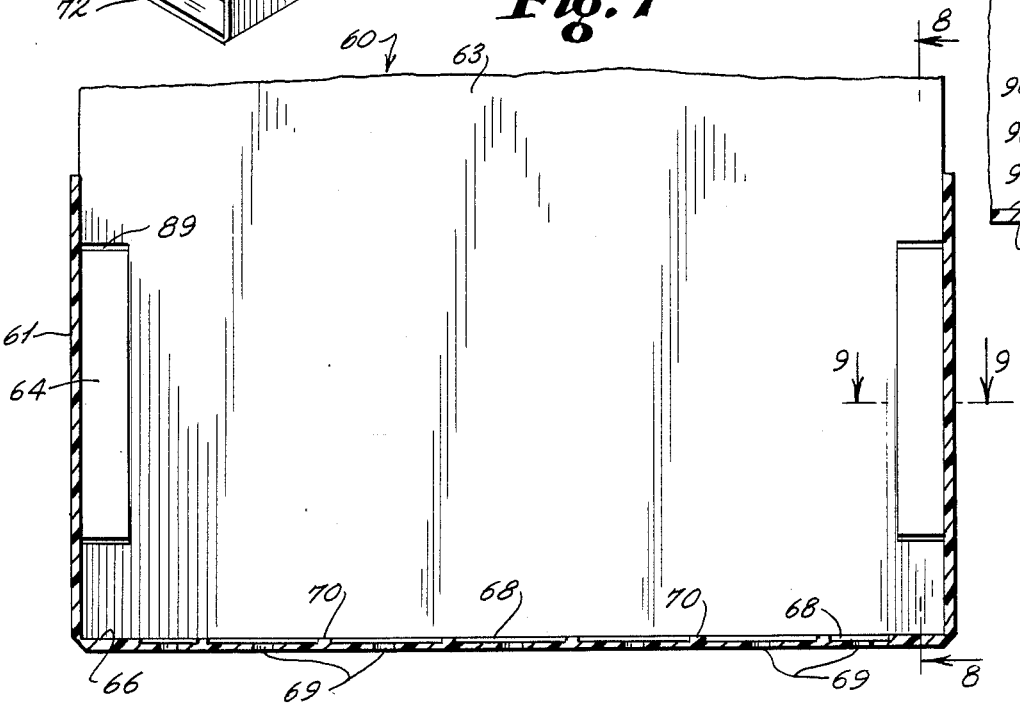

EXTENDABLE MAILBOX TRAYS

BACKGROUND OF THE INVENTION

1. Field of the Invention

This invention is generally related to slideable trays which are utilized within rural route mailboxes of the type approved by the Postmaster General of the United States so as to receive mail and packages placed therein and which are extendable outwardly from the mailboxes to permit easy access to articles placed therein. In particular, this invention is directed to trays which are manufactured in generally sheet configuration and are foldable along prepared lines and distributed in a relatively compact and flat package. The trays may be unfolded and assembled by the ultimate postal patron. In a preferred embodiment of the invention, the sheet material from which a tray is formed is selectively folded and assembled into one of two or more sizes thereby enabling one size of sheet material to be adapted for use in varying sizes of conventional rural route mailboxes.

2. History of the Prior Art

There have been numerous proposals directed to facilitating the placement and removal of mail from rural mailboxes. Such mailboxes are of the type which are generally mounted on posts or poles along roadsides or curbs so as to be accessible to post office delivery personnel. Postal regulations require specific placement criteria which are designed to enable personnel to gain access to the mailboxes without having to leave their vehicle. Unfortunately, it is not always possible for either delivery personnel or homeowners to maneuver their vehicles into the proper proximity with respect to a mailbox in order to place mail therein or take mail therefrom.

Often, a person in a vehicle will approach a mailbox and be in close enough proximity to open the mailbox door thereof only to find the contents out of reach adjacent the rear of the box. Under such conditions, the person must exit their vehicle in order to obtain the contents of the mailbox. In addition to the inconveniences inherent in the use of rural route mailboxes is the unfortunate circumstance that their use often times results in costly property damage. Again, because mailboxes must be closely approached by persons in automotive vehicles, it often happens that a vehicle make contact with the mailboxes or their supports thereby causing damage to both the box and the vehicle.

Because of the problems and/or inconveniences associated with the use of rural route mailboxes, there have been many structures developed in an effort to make the placement and retrieval of mail from such mailboxes more easily accomplished. Many of these structures, however, are too complex or too costly to be useful. In U.S. Pat. No. 2,279,622, a somewhat complex telescoping support structure for mailboxes is disclosed which enables a mailbox to be extended with respect a support post. Although the provision of telescoping members enables the mailbox to be moved horizontally with respect to the support post thereby increasing the ease of access thereto, such structure is complicated and expensive and therefore not practical for normal use. As rural route mailboxes are frequently the objects of abuse or vandalism which results in the need for their replacement, it is essential that the cost of the equipment used be minimal. Overly complex structures such as that disclosed in the aforementioned patent are therefore not practical.

In U.S. Pat. Nos. 660,773 to Henry, 1,139,491 to Coon and 2,781,964 to Ledgerwood mailbox structures are disclosed which have been designed to be extensible. As with the extendable support structures, such mailboxes are extremely complex requiring multiple components which are locked or retained in slideable relationship with respect to one another in order to permit an inner element to be extended and cantilevered from an outer housing. Not only are many of such structures not designed within the parameters established by the United States Postal Service but such structures are also complicated and expensive and therefore not practical for use.

More practical solutions to the problems associated with gaining access to mail within rural mailboxes are disclosed by U.S. Pat. Nos. 2,868,444 to Whittier and 4,362,267 to Donaldson. These inventions disclose the use of more simplified forms of trays which may be used within existing rural route mailboxes in order to receive mail being placed therein. Such trays have an advantage over other prior art devices in that they may be formed more economically and therefore may be considered for optional use by homeowners for placement in an existing mailbox. However, such units do not fully appreciate that there are a number of conventional sizes of rural route mailboxes which are in use. As the Post Office has approved rural route mailboxes having not only different sizes but different cross-sectional areas, it is important from a manufacturing and sales point of view to provide a product which can be suitably used in as many mailboxes as possible. Also, such prior art trays have not been designed to facilitate product distribution. Failure to consider these problems has resulted in manufacturing and distribution cost increases. Due to the frequent need to replace damaged or vandalized mailboxes, it is important that the product be of a type which is affordable to homeowners and yet which is durable and funtional.

Some additional examples of the prior art include U.S. Pat. Nos. 4,160,520 to Cluthe, 3,606,140 to Shannahan, 3,163,346 to Joehnk and 4,363,438 to Connor.

SUMMARY OF THE INVENTION

Extendable trays for mailboxes which are manufactured in sheet form having a plurality of integrally formed fold lines or integral hinges therein which enable the sheet material to be folded into a relatively flat configuration and of a size to be packaged for distribution by mail for delivering to rural locations, and which may be unfolded and assembled to form trays which may be slideably carried within conventional rural route mailboxes. In one embodiment of the invention, the sheet material is manufactured having a plurality of groups of spaced generally parallel fold or score lines so that the material may be selectively folded and assembled to create trays which cooperatively fit any of several sizes of conventional mailboxes. The sheet material may also be provided with an integrally formed handle which may be utilized to urge the tray from a mailbox in which the tray is in use and yet is yieldable so as to permit mail to be easily inserted therein. The trays are designed so as to be stable when extended from the interior of a mailbox but may be easily removed in order to permit the trays and contents to be carried away from the mailboxes and thereafter the trays reinserted for future use. In this manner, the trays may function as mail carriers as well as slideable trays for mailboxes. The material from which the trays are formed is preferrably a moldable plastic which may be provided with a series of channels or grooves therein in which a plurality of openings are provided in order to allow the drainage of water therefrom in the event water enters a mailbox in which a tray is utilized. In addition, a series of raised ridges separate the channels and provide elevated support surfaces which will insure articles placed therein to be retained in an elevated relationship with respect to the drainage channels.

It is the primary object of the present invention to provide a mailbox insert or tray which may be selectively shaped from a substantially integral sheet of material which is manufactured having separate fold lines or integrally formed hinges so that the tray may be shipped to retail stores or ultimate consumers in a flat configuration and thereafter folded by the consumer into the proper configuration to fit a particular mailbox.

It is also an object of the present invention to provide a mailbox insert or tray which is designed and constructed from a single sheet of material to be foldable utilizing a first set of fold lines or integral hinges into a relatively flat configuration of a size to be packaged and distributed by mail directly to a homeowner and which is thereafter unfolded and reassembled by the homeowner utilizing a second set of fold lines into a size and shape to be utilized as an extendable tray for rural route mailboxes.

It is another object of the present invention to provide a slideable mailbox tray for use in receiving letters, papers and packages placed within conventional rural route mailboxes which may be manufactured as a single sheet of material which may be folded into any of a number of selected sizes so that the consumer may form the tray into the proper size to fit a particular mailbox.

It is also an object of the present invention to provide extendable mailbox trays for use in conventional rural route mailboxes which are designed to be more economically manufactured, packaged and shipped than other mailbox trays and which may even be shipped in mailing envelopes directly to ultimate consumers.

It is a further object of the present invention to provide extendable mailbox trays for use with rural route mailboxes which are removable from such mailboxes so as to act as carrying trays for mail or other packages placed within the mailbox and which are easily reinserted within the mailboxes and which are assembled without the requirement for additional fasteners or tools.

It is also an object of the present invention to provide extendable mailbox trays for use in rural route mailboxes where the trays may function adequately even where the mailbox housing has been slightly bent or otherwise damaged.

BRIEF DESCRIPTION OF THE DRAWINGS

FIG. 6 is a perspective view illustrating a preferred form of the invention wherein the prefabricated sheet material is formed to be compatible with a single size of mailbox and wherein the sheet material is prepared to be folded into a first configuration for shipping or distribution and subsequently assembled into a second configuration for use as a mailbox tray.

FIG. 7 is an enlarged partial cross sectional view taken along lines 7—7 of FIG. 6.

FIG. 8 is a partial cross sectional view taken along lines 8—8 of FIG. 7 showing the integral locking tab for securing the side and rear panels which form the mailbox tray of FIG. 6.

FIG. 9 is a partial cross sectional view taken along lines 9—9 of FIG. 7 also showing the locking tab for assembling the embodiment of invention shown in FIG. 6.

DESCRIPTION OF THE PREFERRED EMBODIMENT

Figure 1:
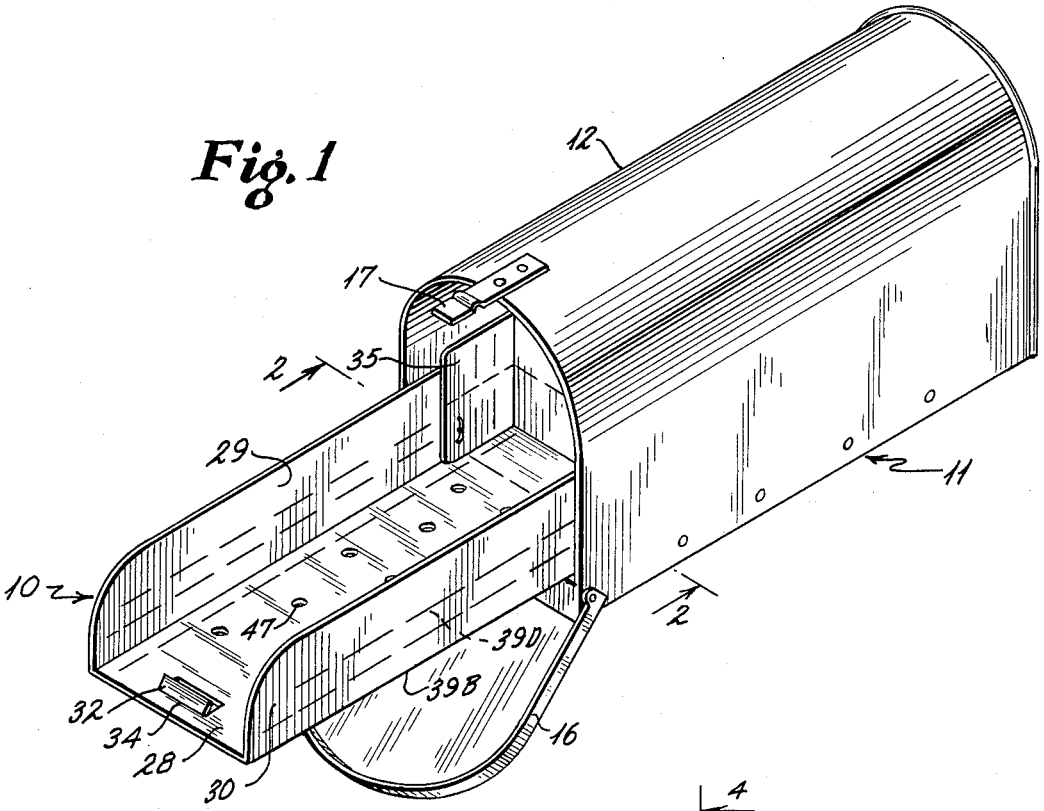
FIG. 1 is perspective view illustrating one embodiment of extendable tray formed in accordance with the present invention as it selectively extended from a conventional rural route mailbox.
Figure 2:
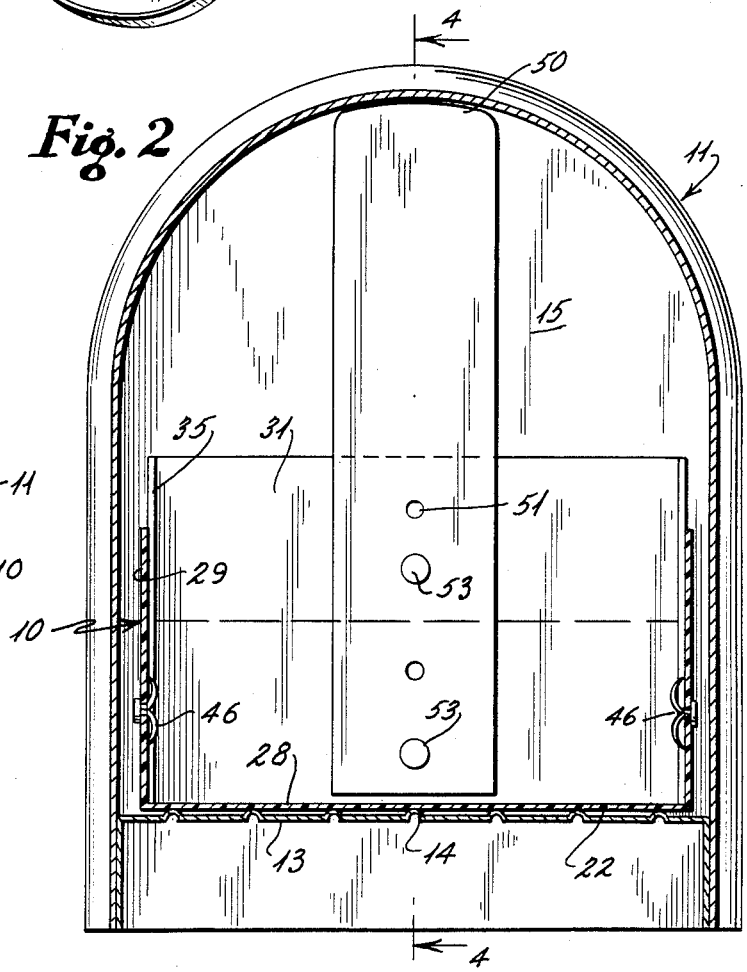
FIG. 2 is an enlarged cross-sectional view taken along lines 2—2 of FIG. 1.

With continued reference to the drawings, a mailbox tray 10 representing a first embodiment of the invention is shown in FIGS. 1 and 2 as being slidingly received within a conventional rural route mailbox 11. The rural route mailbox is of a type approved by the Postmaster General of the United States and includes an elongated and generally arcuate outer housing 12 which is joined at its lowermost edges by a bottom wall 13 which may be corrugated as shown at 14. The elongated housing is permanently closed at one end by a back wall 15 with access thereto being permitted through a hinged door or closure 16 which is frictionally locked in closed position by means of a spring clip 17.

Although only one type of rural route mailbox 11 is shown in the drawings, it should be emphasized that the mailbox trays of the present invention may be cooperatively utilized with most mailboxes which are approved by the Postal Service for rural mail delivery. The specific form of mailbox shown in the drawings represents the most conventional type of mailbox used for rural mail deliveries. Such mailboxes are generally manufactured and distributed in several sizes having the same general configuration. It is one of the primary purposes of the present invention to provide mailbox trays which may be utilized with one of any number of sizes of such conventional mailboxes.

The mailbox trays are formed or manufactured from a sheet of material 20 which is generally rectangular in configuration having upper and lower surfaces 21 and 22, elongated side edges 23 and 24 and front and rear edges 25 and 26, respectively. The sheet material 20 is preferrably formed from a high density plastic which is not affected by harsh weather conditions including temperatures below freezing or temperatures which are experienced in the heat of the summer.

With specific reference to FIG. 1, the mailbox tray 10 which is formed from the sheet material 20 includes a bottom wall 28 opposing side walls 29 and 30 and rear wall 31. In addition, a handle 32 is provided adjacent the leading edge 25 of the tray and is connected to the bottom of the tray 28 through an integrally formed hinge 34. The handle is movable through hinge 34 to a generally vertical position to permit the handle to be readily available to pull or urge the tray from a mailbox. The hinge also allows the handle to automatically recline to a horizontal position as packages or mail are inserted into the mailbox.

In order to join the side walls 29 and 30 to the rear wall 31, a pair of outwardly extending flange members 35 and 36 extend from the rear wall portion and along a portion of the side walls 29 and 30. A plurality of openings 45 and 46 are provided through the side walls 29 and 30 and flange members 35 and 36 through which spreadable fasteners, rivets or the like 47 may be inserted so as to lock the flanges with respect to the side walls when the openings are aligned.

As previously discussed, the sheet material is prepared so that the mailbox tray formed therefrom is of a size to be cooperatively received within a conventional mailbox. This preparation of the sheet material may be accomplished by providing first and second sets of longitudinally extending scored or molded lines 38 and 39 along the underside or lower surface 22 adjacent the edges or sides 23 and 24 of the sheet material and a third set of scored of molded lines 40 which extend perpendicularly with respect to the fold lines 38 and 39 between the sides 23 and 24 of the sheet material and adjacent the end portion thereof. The fold lines may be prepared by cutting or slicing the sheet material through a portion of its thickness or alternatively, may be formed by molding integral hinges or lines of reduced thickness into the sheet material. The fold lines 38 and 39 are used to form the mailbox tray to an appropriate width whereas the fold lines 40 are used to form the tray to an appropriate length.

Figure 3:
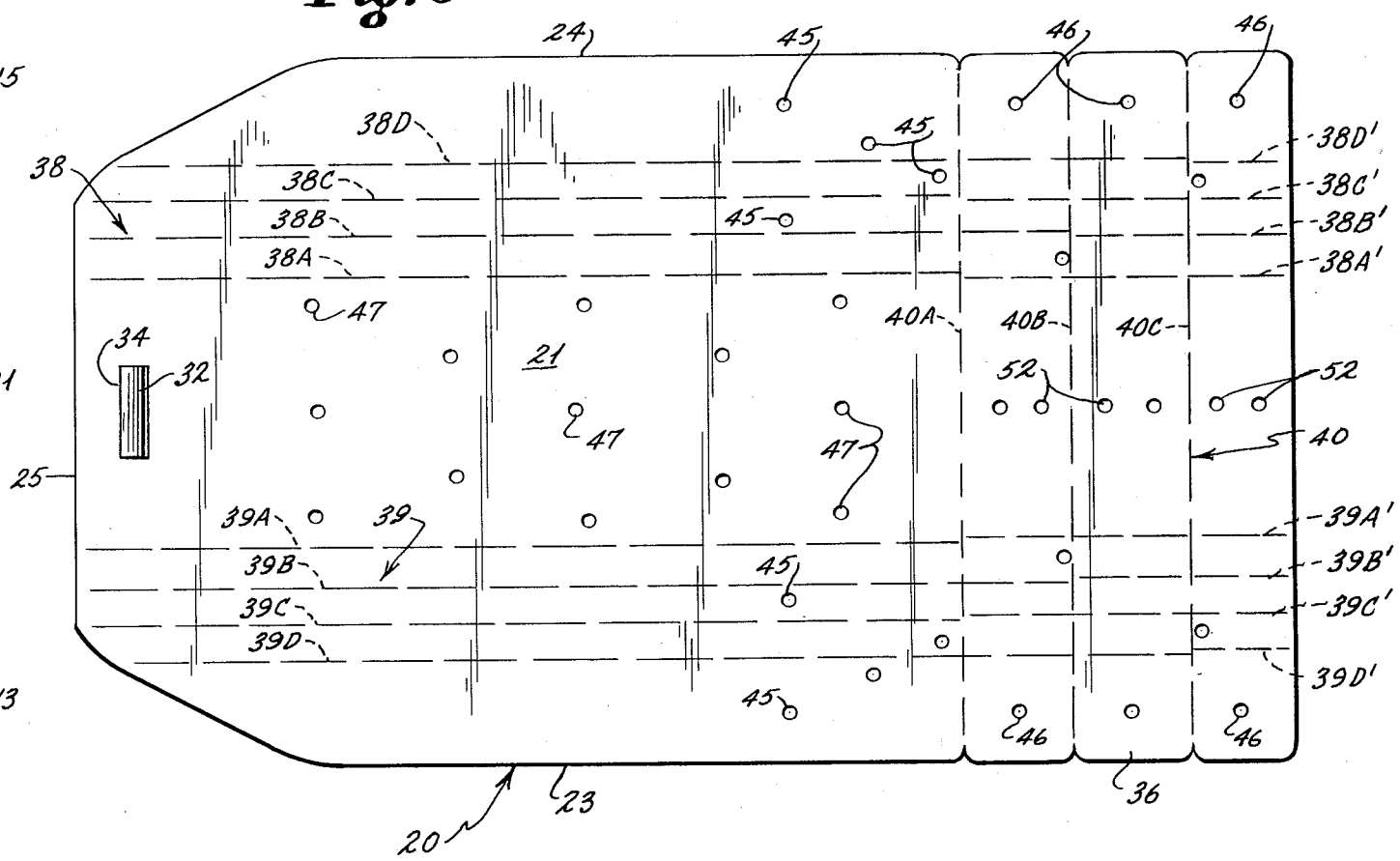
FIG. 3 is a top plan view of sheet material which is prepared to be folded to form the embodiment of the invention shown in FIG. 1 and showing a plurality of score lines or fold lines which permit the material to be adapted for use in varying sizes of conventional mailboxes.
Figure 4:
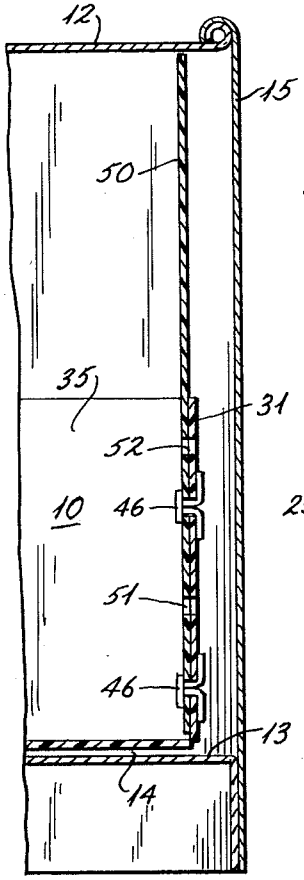
FIG. 4 is a partial cross-sectional view taken along lines 4—4 of FIG. 2 showing the rear of the tray adjacent the rear wall of the mailbox.

As shown in FIG. 3, the mailbox tray may be selectively formed into one of four different widths designated by pairs of scored or molded lines 38 A and 39 A through 38 D and 39 D, respectively. In addition, the embodiment shown in FIG. 3 may be formed having one of three separate lengths designated by fold lines as 40 A through 40 C. As previously discussed, when the mailbox tray is folded by the consumer, the side flanges 35 and 36 are engaged with the side walls 29 and 30 and are secured thereto by separate fastening means. In order to provide a rear wall which is a proper width for the tray, the fold lines 38 and 39 are shown as being offset or including offset portions 38' and 39' which intersect with the fold lines 40. If the flange portions 35 and 36 are to be situated inside of the side walls 29 and 30 of the tray then the offset fold lines 38' and 39' are made inwardly with respect to the fold lines 38 and 39 as shown in FIG. 3. This spacing will permit the flange portions to fit interiorly of the side walls 29 and 30 when the end wall is bent up into abutting configuration with the side walls as shown in FIGS. 1 and 2. In addition, the offset fold lines 38' and 39' extend through different lengths depending upon the overall length of the tray which is to be formed. In FIG. 3, the offset or supplemental scored or molded lines are designated as 38 A' through 38 D' and 39 A' through 39 D'. In the event it is desired for the flange members 35 and 36 to be fitted outside of the side walls 29 and 30 of the tray, then the supplemental fold lines 39 A' through 39 D' and 38 A' through 38 D' would be situated to the outside of the respective fold lines 38 A through D and 39 A through D.

Figure 5:
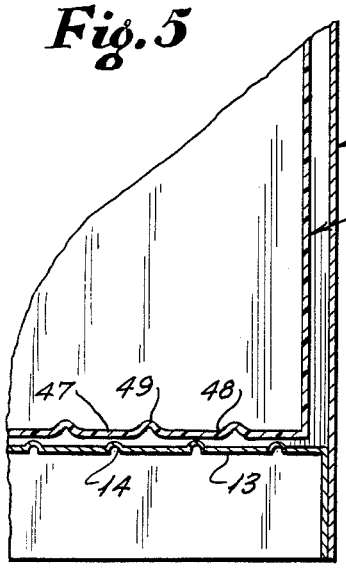
FIGS. 5 and 5A are segmented cross-sectional views of alternative embodiments of the invention wherein the sheet material from which the extendable trays of FIG. 1 are formed are provided with a series of parallel upwardly extending corrugations or ridges which will support articles placed within the trays and elevate them in spaced relationship with respect to drainage holes or openings in the bottom walls of the trays.
Figure 5A:
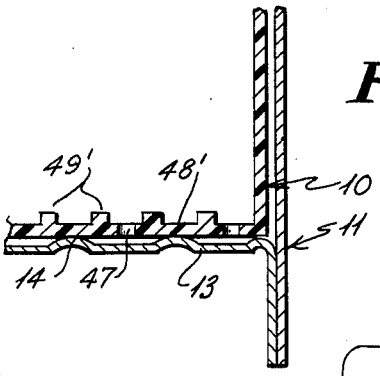

As previously discussed, in order to permit the fastening elements to be selectively insertable to join the folded portions of the mailbox tray into assembled relationship with respect to one another, a plurality of predrilled openings or holes 45 are made through the sheet material. The holes 45 are aligned with one another when folded and the fastening elements 46 are inserted therethrough as shown in FIGS. 1 and 2. In addition to the openings 45, a plurality of drainage holes 47 are made through the lower wall portion of the mailbox tray to permit the passage of fluid therethrough in the event moisture accumulates within a mailbox in which a tray is to be utilized. If desired, and as shown as modifications in FIGS. 5 and 5A, the bottom of the tray may be formed having a plurality of longitudinally extending corrugations 48 or 48' which extend along the length thereof and which form water collecting channels in which the drainage holes 47 are located. The ridges 49 and 49' formed between the channels will support articles placed within the tray in spaced relationship with respect to the bottom wall thereof thereby insuring such articles will be spaced from the drainage holes 47.

Although not shown in the drawings, it should be noted that instead of attaching or fastening the flanges 35 and 36 to the side walls of the tray, the flanges may be formed by cutting along the secondary scored or molded lines 38' and 39' and thereafter folding the flanges against the rear wall 31 of the tray. In this regard, instead of the openings 45 being made in the side walls 29 and 30, such openings would be made in the rear wall 31 so as to be selectively aligned with the openings 46 in the flanges.

With specific reference to FIG. 2, a vertical brace 50 may be secured to the rear wall of the mailbox tray so as to extend upwardly into close proximity with the uppermost portion of the mailbox housing. The vertical brace member includes a plurality of openings 51 which are aligned with openings 52 through the rear wall and which permit fasteners 53 to be inserted therethrough to support the brace member against the rear wall. The brace member 50 will engage the inner uppermost surface of the mailbox thereby stabilizing the tray in a generally horizontal orientation with respect to the mailbox when the tray is extended therefrom as shown in FIG. 1. Although the brace 50 is shown as being of one piece construction, such member could be provided with scored lines to permit the member to be severed into different lengths so as to provide the appropriate vertical height for use with each size of mailbox. In addition, the vertical brace may be integrally formed with the rear wall of the tray so that separate fasteners would not be required as will be discussed with regard to the embodiment of the invention shown in FIG. 6.

As previously discussed, one of the advantages of the present invention is that a number of sizes of mailbox trays can be selectively formed from a single sheet of material. With reference to the embodiment of the invention shown in FIGS. 1 and 3, the mailbox tray is manufactured as a single sheet of material 20 which is shipped or distributed in a flattened configuration. When the consumer is ready to install the mailbox tray 10 into a conventional rural mailbox, it is only necessary to take the measurements of the mailbox and fold the sheet material accordingly. In this process, it is first necessary to match the width of the mailbox with the appropriate fold lines 38 and 39 and then fold the sheet material along the length of the selected lines 38 A through 38 D and 39 A through 39 D by placing the sheet material on a surface and bending the material along a straight edge. The mailbox is then measured for an appropriate length with the length being matched by bending the sheet material along an appropriate fold line 40 A through 40 C. When the correct length is established, a pair of scissors or other cutting tool should be used to cut the edges to define the flange portions 35 and 36. In the configuration shown in FIGS. 1 and 3, the flange portions 35 and 36 should be folded inwardly over the rear or end wall of the tray thereafter folding the rear wall up into abutting relationship with the side walls 29 and 30. In this manner, the flanges 35 and 36 will be spaced inwardly of the side walls of the tray. The openings in the side walls and flanges are aligned and suitable fastening elements are positioned through the openings and locked into place. Thereafter, the vertical element 50 is measured to match the height of the mailbox and secured to the end wall as previously discussed. The mailbox tray 10 is now ready for insertion into the housing of the mailbox 11. The handle 32 which is integrally formed with the tray is utilized to assist a person in pulling the tray from the mailbox with the tray being simply reinserted by urging the front portion thereof toward the rear wall of the mailbox.

Although the embodiment of the invention disclosed in FIGS. 1 and 3 shows a specified number of fold lines, it should be noted that any number of fold lines could be used so as to permit the sheet material to be adaptable to any number of preselected mailbox sizes.

With respect to FIGS. 6–13B of the drawings, another embodiment of the invention is disclosed. In this embodiment, the sheet material is shown as being designed to be folded for a single or specific size of mailbox. The mailbox tray of this embodiment has been designated as number 60 and includes a pair of side walls 61 and 62 which are joined at their ends to a rear wall 63 by locking flange or tab members 64 and 65. The floor or bottom 66 of the tray has a number of elongated recessed channnels 68 formed therein in which a plurality of openings 69 are located in order to provide for the drainage of any water which may enter the mailbox tray. The recessed channels actually function as drainage troughs to facilitate the drainage of water from the tray. The ridges 70 created between the channels provide elevated surfaces for supporting packages and letters above any water which has been collected in the channels.

To facilitate movement of the tray with respect to a mailbox, a handle 71 is integrally formed adjacent the leading edge 72 thereof. The handle is pivotally movable so as to be selectively raised for use in urging the tray from a mailbox and yet yieldable to a lowered position to permit articles to be placed into the mailbox. The rear wall 63 extends upwardly and in use with be in proximate relationship with the inner upper portion of the elongated housing of a mailbox into which the tray is installed. In this manner, the rear wall thereby functions as a vertical brace member to prevent the tray from being vertically displaced as it is pulled from a mailbox.

The mailbox tray of the present embodiment is generally constructed in a manner similar to the embodiments of FIGS. 1–3 with the exception that the mailbox tray is designed and formed so as to be initially folded into a first configuration for shipping and thereafter re-folded or assembled to form a tray. The advantage of this embodiment is that the trays are initially folded and packaged in a letter sized envelope which can be mailed to a consumer thereby enabling the product to be directly distributed from the manufacturer to the ultimate purchaser. This direct distribution of the product will reduce costs and facilitate the handling and marketing of the product.

Figure 11:
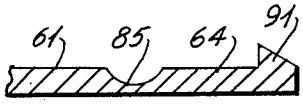
FIG. 11 is an enlarged partial cross sectional view taken along lines 11—11 of FIG. 10 and showing the molded integral hinges which permit the locking tabs to be folded.
Figure 12:
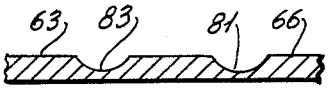
FIG. 12 is an enlarged partial cross sectional view taken along lines 12—12 of FIG. 10 and showing the molded integral hinges for the rear wall of the tray.
Figure 10:
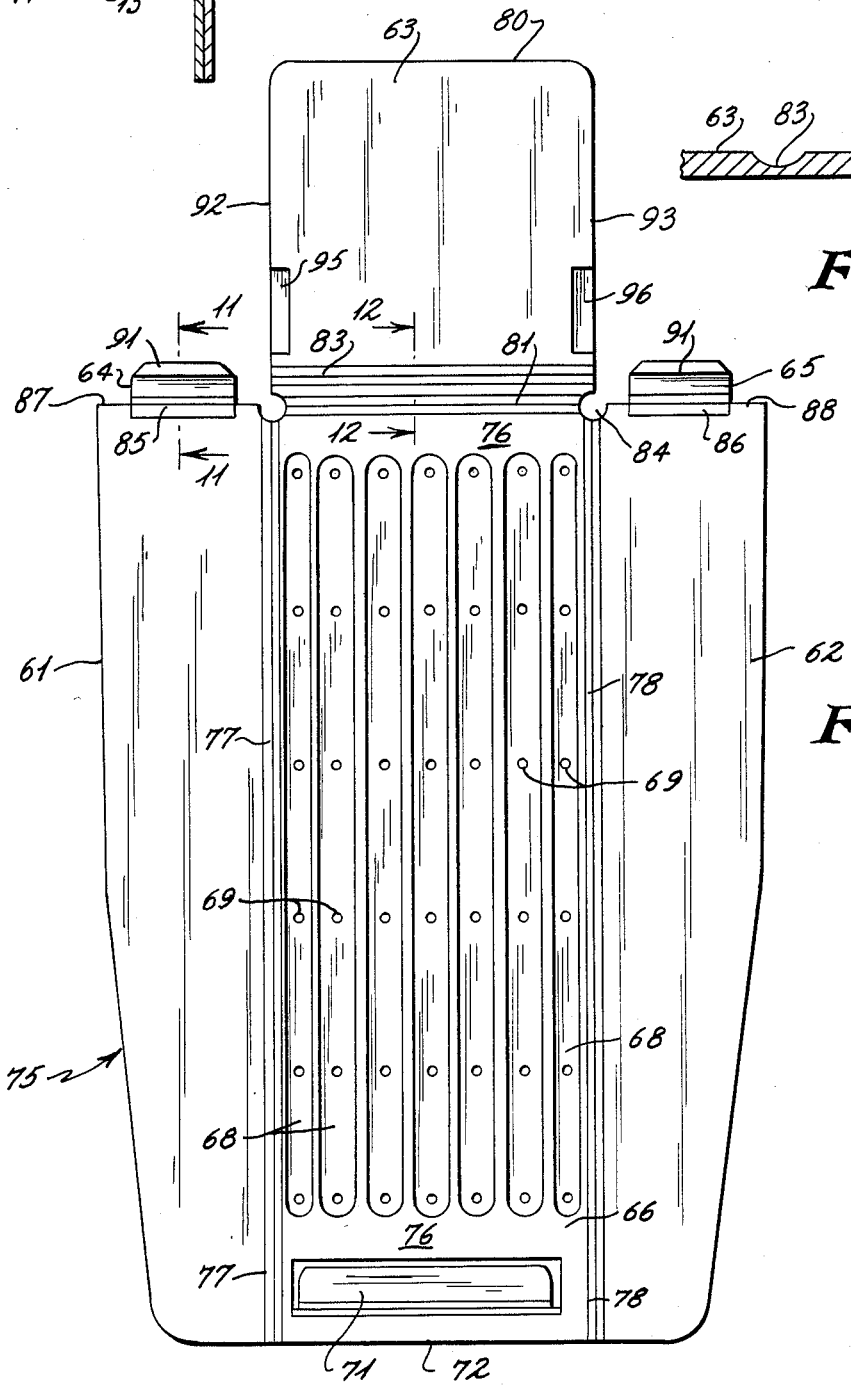
FIG. 10 is a top plan view of the sheet material which is prepared to be folded to form the embodiment of FIG. 6.

With specific reference to FIGS. 10–12, the mailbox tray 60 is formed or manufactured from a generally planar sheet of material which is preferrably a plastic material and is designed to be ultimately assembled or folded into the configuration shown in FIG. 6. In this embodiment, instead of cutting or scoring the sheet material to create foldable seams, the seams are molded by forming grooves or recesses into the material which thereafter function as integral hinges.

The sheet material 75 includes an upper surface 76 which is molded having a pair of spaced longitudinally extending hinges or fold lines 77 and 78 which extend from the front edge 72 toward the rear edge 80 thereof and which unite the side walls 61 and 62 to the bottom 66 of the tray. The rear wall 63 is likewise integrally connected to the bottom 66 of the tray by way of an integral hinge or fold line 81 which extends perpendicular to and between the lines 77 and 78. The rear edge 80 of the sheet material forms the upper edge of the rear wall when the wall is raised into an assembled position.

Figure 13:
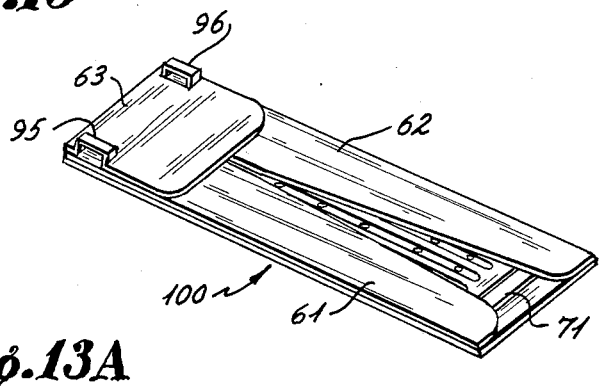
FIGS. 13 through 13B are perspective illustrational views showing the embodiment of mailbox tray sheet material shown in FIG. 10 as it is initially folded for shipment, unfolded from the shipping configuration and subsequently assembled as a mailbox tray similar to the tray shown in FIG. 6.

A second hinge or fold line 83 is formed along the rear wall and is spaced from fold lines 81 by a distance equal to approximately two to three times the thickness of the sheet material. The second transversely extending fold line 83 is provided in order to permit the rear wall 63 to be folded into an overlying and generally parallel relationship with the side walls 61 and 62 when the side walls are folded into overlying relationship with the bottom 66 of the tray as shown in FIG. 13. The spacing between the fold lines 81 and 83 will allow the rear wall to lay generally flat against the folded-in side walls. Clearance to permit the rear wall to be folded over the side walls is also facilitated by providing a pair of notches or openings 84 adjacent the intersection of the outermost side of the rear wall and the rear portions of the side walls.

The locking flanges or tabs 64 and 65 are also integrally formed from the sheet material 75 and are integrally connected thereto by molded hinges or fold lines 85 and 86. The fold lines 85 and 86 are formed adjacent the rear edges 87 and 88 of the side walls 61 and 62, respectively. The hinges or fold lines 85 and 86 permit the flanges 64 and 65 to be folded into overlying relationship with the bottom 66 of the tray when the side walls are folded over as shown in FIG. 13 and also permit the flanges to be pivoted into an interfitted relationship within locking openings 89 and 90 formed along either side of the rear wall 63.

To secure the rear wall 63 to the side walls 61 and 62, the locking flanges or tabs 64 and 65 extend rearwardly from the rear edges 87 and 88 of the side walls. The outer ends of each locking flange are tapered to create an enlarged ridge 91 for purposes which will be discussed hereinafter.

The locking flanges 64 and 65 are cooperatively receivable within the pair of spaced elongated openings 89 and 90 which are formed adjacent the edge portions 92 and 93 of the rear wall 63. The openings may be formed by providing a slit or slot through the rear wall adjacent each edge of a size to permit the locking flanges to be inserted therethrough. Once inserted through the openings 89 and 90, the enlarged ends or ridges 91 of the locking flanges will prevent the withdrawal of the flanges thereby securing the side walls and rear wall of the tray in an assembled relationship.

With particular reference to FIGS. 7–9, one method of forming the openings 89 and 90 is shown in detail. The openings are formed at the edge portions 92 and 93 of the rear wall and between the back surface 94 of the rear wall and a pair of spaced retaining members or strips 95 and 96. The retaining strips are spaced outwardly in generally parallel relationship with respect to the rear wall of the tray and are joined at their upper and lowermost ends 97 and 98 to the rear wall. The retaining strips may either be integrally molded with the rear wall of the tray or attached thereto by suitable fasteners or adhesives. The width and height of the openings 89 and 90 are of a size to permit the locking tabs to be extended therethrough. The tapered enlarged ends of the locking flanges are greater in dimension than the width of the openings and are inserted therethrough by deflecting the retaining strips outwardly with respect to the rear wall of the tray. After insertion, the locking flanges are prevented from being withdrawn as the retaining strips 95 and 96 will engage the ridged ends 91 of the tabs thereby preventing their withdrawal.

Although not specifically shown in the drawings, it should be noted that the locking flanges 64 and 65 and openings 89 and 90 together with retaining strips 95 and 96 could be reversed in their respective locations. That is, the flanges would be integrally formed so as to extend from the edges of the rear wall with the openings and retaining flanges being provided adjacent the rear edge of each of the side walls.

As shown in the enlarged cross sections of FIGS. 11 and 12, the living hinges or fold lines are grooved or molded into a U or V-shape leaving a minimum of sheet material to act as the movable joint between the respective parts of the tray. The somewhat enlarged depression D made in the sheet material will permit the folding of one part of the tray into overlapping position with and adjacent part as shown in FIG. 13.

With specific reference to FIGS. 13–13B, the double fold capability of the present embodiment will be discussed in greater detail. In FIG. 13, the locking flanges 64 and 65 have been folded into overlapping position with the side walls 61 and 62 and thereafter the side walls folded along lines or hinges 77 and 78 into overlapping relationship with respect to the bottom 66 of the tray. Subsequently, the rear wall 63 is folded through lines or hinges 81 and 83 into overlapping relationship with the side walls. The completely folded unit is now ready for packaging or mailing. The initially folded unit 100 as shown in FIG. 13 is small enough to permit the tray to be mailed by specified postal rate directly to the consumer and will completely fit within a rural route mailbox of a size in which the tray is to be used when fully assembled.

Figure 13A:
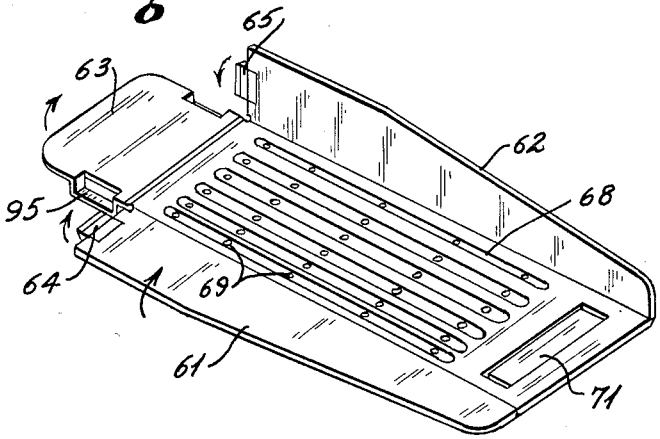
Figure 13B:
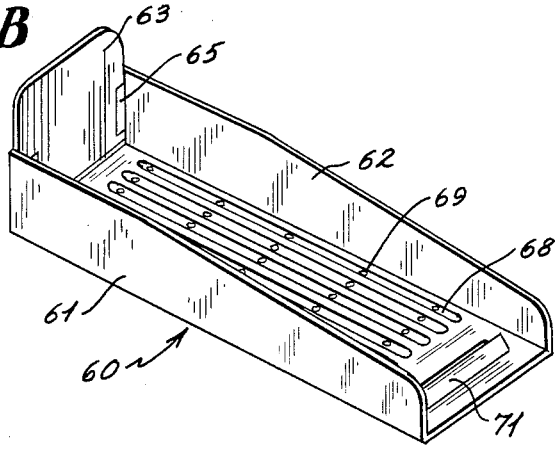

Once the tray has been received by the consumer as a folded unit 100, the consumer may unfold the rear wall, side walls and locking flanges as shown in FIG. 13A. Thereafter, the mailbox tray is assembled or folded into proper form by raising the rear and side walls into a vertical orientation and then locking the flanges 64 and 65 into the openings 89 and 90 of the locking strips 95 and 96.

The mailbox tray 60 is now ready for placement into a rural mailbox. The flat or smooth bottom surface of the tray will enable the tray to be easily moved within the mailbox. As the height of the rear wall is just slightly less than the inside clearance height of the mailbox, the rear wall will engage the upper inner surface thereof to stabilize the tray and maintain the tray in a horizontal orientation even though the tray is fully extended or cantilevered from the mailbox.

In the event any moisture should collect on the tray, such moisture will be directed through the channels 68 and through the drainage openings 69 in the bottom of the tray. Meanwhile, any packages, letters or other mail will be elevated above the moisture by the ridges 70 formed between the drainage channels.

We claim:

1. A foldable mailbox tray for use in rural route mailboxes having a housing defined by a floor and an upper inner wall portion in which the foldable mailbox tray comprises a bottom wall having upper and lower surfaces and front and rear portions, spaced side walls and a rear wall extending between said side walls, at least one channel means formed in said upper surface of said bottom wall, each of said side and rear walls being integrally and hingedly connected to said bottom wall along fold lines said side and rear walls being selectively movable from a relatively flat sheet-like configuration to a first generally parallel and overlapping relationship and alternatively to a second generally perpendicular relationship with respect to said bottom wall, said rear wall having an uppermost edge and spaced side edges, said side walls having front and rear edges, a pair of spaced locking means adjacent each of said side edges of said rear wall and said rear edges of said side walls for securing said rear walls and said side walls to one another, and means for draining moisture from said channel.

2. The mailbox tray of claim 1 including a plurality of channels formed in said upper surface of said bottom wall, a plurality of upstanding ridges formed between said channels, and a plurality of drainage openings through said bottom wall and oriented within said channels.

3. The mailbox tray of claim 1 in which said rear wall is of a height to extend to a point spaced from but proximate to the upper inner wall portion of the mailbox when said bottom wall is in engagement with the floor of the mailbox.

4. The mailbox tray of claim 1 in which said locking means includes flange means integrally connected to and extending from one of said rear edges of said side walls and said side edges of said rear wall and means for securing said flange means to connect said rear wall to said side walls.

5. The mailbox tray of claim 4 in which said rear wall includes a secondary fold line oriented in vertically spaced relationship with and parallel to said fold lines connecting said rear wall to said bottom wall.

6. The mailbox tray of claim 1 in which said locking means includes a flange member integrally connected to and extending from said rear edge of said side walls, and a pair of retainer means mounted adjacent said side edges of said rear wall for selectively engaging said flange means.

7. The mailbox tray of claim 6 in which said flange means are foldably connected to said side edges so as to be selectively positioned in overlapping relationship therewith, said rear wall including a secondary fold line oriented in vertically spaced and parallel relationship to said fold line connecting said rear wall to said bottom wall whereby said rear wall may be selectively folded into overlaying relationship with said side walls and said flange means when said side walls are folded into overlapping relationship to said bottom wall.

8. The mailbox tray of claim 1 in which each of said locking means includes a flange means integrally connected to and extending from said side walls adjacent said rear edges thereof, each of said flange means having a tapered outer end portion creating an enlarged ridge spaced inwardly from the outermost end thereof, a pair of spaced openings in said rear wall adjacent the side edges thereof, said openings being of a size to permit said outer end portion of said flange means to be inserted therethrough with said enlarged ridge preventing the withdrawal of said outer end portion therefrom.

9. The mailbox tray of claim 8 including retaining strips having upper and lower ends which are attached to said rear wall and extending in spaced generally parallel relationship to said rear wall, said openings in said rear wall being defined between said rear wall and said retaining strips.

10. The mailbox tray of claim 9 in which said flange means are foldably connected to said side edges so as to be selectively positioned in overlapping relationship therewith, said rear wall including a secondary fold line oriented in vertically spaced and parallel relationship to said fold line connecting said rear wall to said bottom wall whereby said rear wall may be selectively folded into overlaying relationship with said side walls and said flange means when said side walls are folded into overlapping relationship to said bottom wall.

11. In a mailbox tray for use in rural route mailboxes having housings defined by a floor and an upper inner wall portion and in which the mailbox tray includes a bottom wall having upper and lower surfaces, spaced side walls having forward and rear ends and a rear wall having side edges, the improvement comprising, the mailbox tray being formed of sheet material in which said side walls are connected to said bottom wall by integrally formed longitudinal fold lines so that said side walls may be selectively moved with respect to said bottom wall, said rear wall being connected to said bottom wall by an integrally formed transversely extending fold line so that said rear wall may be seletively moved with respect to said bottom wall, the mailbox tray being selectively foldable into a first relatively flat configuration wherein said side and rear walls are overlapped with and generally parallel to said bottom wall and are alternatively folded into an assembled configuration wherein said side and rear walls are generally perpendicularly oriented in upstanding relationship with respect to said bottom wall, and means associated with each of said side and rear walls for selectively connecting said side and rear walls in said upstanding relationship.

12. The improvement in a mailbox tray of claim 11 including outwardly extending flange means movably connected adjacent each of said rear edges of said side walls by an integrally formed fold line so that said flange means may be selectively folded into overlapping relationship to said side walls, and retention means adjacent each of said side edges of said rear wall for retaining said flange means therein.

13. The improvement in a mailbox tray of claim 12 including a second transverse fold line across said rear wall, said second fold line being vertically spaced from and parallel to said transverse fold line between said rear wall and said bottom wall, said second fold line permitting said rear wall to extend generally parallel to said bottom wall when said side and rear walls are selectively folded into said first relatively flat configuration.

14. The improvement of a mailbox tray of claim 13 including a plurality of elongated channels formed in said upper surface of said bottom wall, a plurality of upstanding ridges formed between said channels, and openings in said channels and through said bottom wall to provide drainage therethrough.

15. The mailbox tray of claim 14 in which said fold lines are molded lines of reduced material thickness in said sheet material.

* * * * *